US011200857B2

(12) United States Patent
Kang

(10) Patent No.: US 11,200,857 B2
(45) Date of Patent: Dec. 14, 2021

(54) METHODS AND DEVICES FOR PIXEL SIGNAL CONVERSION

(71) Applicant: HKC Corporation Limited, Guangdong (CN)

(72) Inventor: Chih Tsung Kang, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/041,492

(22) PCT Filed: Nov. 20, 2018

(86) PCT No.: PCT/CN2018/116476
§ 371 (c)(1),
(2) Date: Sep. 25, 2020

(87) PCT Pub. No.: WO2020/093446
PCT Pub. Date: May 14, 2020

(65) Prior Publication Data

US 2021/0134237 A1 May 6, 2021

(30) Foreign Application Priority Data

Nov. 7, 2018 (CN) ..... 201811320177.4

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/3614* (2013.01);
(Continued)

(58) Field of Classification Search
CPC .. G09G 3/3607; G09G 3/3614; G09G 3/3648; G09G 3/2003; G09G 2300/0452; G09G 2340/06
See application file for complete search history.

(56) References Cited

U.S. PATENT DOCUMENTS

2006/0071940 A1 4/2006 Ouchi
2011/0181635 A1* 7/2011 Kabe ..... G09G 3/3406 345/694

FOREIGN PATENT DOCUMENTS

CN 102394040 A 3/2012
CN 104077997 A 10/2014
(Continued)

OTHER PUBLICATIONS

International Search Report for Application No. PCT/CN2018/116476, dated Aug. 14, 2019,2 pages.
(Continued)

*Primary Examiner* — Kwang-Su Yang

(57) ABSTRACT

A pixel signal conversion method, comprising: obtaining a corresponding first stimulus value signal, a corresponding second stimulus value signal, and a corresponding third stimulus value signal according to an initial first subpixel signal, an initial second subpixel signal and an initial third subpixel signal in a pixel signal. When the converted pixel signals are applied to a mixed color display consisting of W, R, G, and B four-color subpixels, the display effect is more approximate to actual presentation of original R, G, and B mixed colors, and the defect of large view color shift is overcome. Also provided is a pixel signal conversion device.

20 Claims, 6 Drawing Sheets

(52) U.S. Cl.
CPC ... *G09G 3/3648* (2013.01); *G09G 2300/0452* (2013.01); *G09G 2340/06* (2013.01)

(56) References Cited

FOREIGN PATENT DOCUMENTS

| | | | |
|---|---|---|---|
| CN | 104471922 | A | 3/2015 |
| CN | 104981861 | A | 10/2015 |
| CN | 105472364 | A | 4/2016 |
| GN | 101350171 | A | 1/2009 |
| GN | 102237025 | A | 11/2011 |
| JP | 2002149143 | A | 5/2002 |
| KR | 1020180063611 | A | 6/2018 |

OTHER PUBLICATIONS

Chinese Office Action for Application No. 201811320177.4, dated Nov. 27, 2019, 7 pages.

* cited by examiner

METHODS AND DEVICES FOR PIXEL SIGNAL CONVERSION

CROSS REFERENCE TO RELATED APPLICATIONS

This application is a U.S. National Stage application of, and claims priority to, PCT/CN2018/116476, filed Nov. 20, 2018, which further claims priority to Chinese Patent Application No. 201811320177.4, filed Nov. 7, 2018, the entire contents of which are incorporated herein in their entirety.

TECHNICAL FIELD

This application relates to methods and devices for pixel signal conversion.

BACKGROUND

In a traditional liquid crystal display, a required display color is typically generated by a color mixture from light sources of three colors generated by three sub-pixels of red (R), green (G), and blue (B). By absorbing optical bands of non-R-G-B sub-pixel units using absorption photoresists of the three sub-pixels of R, G, and B, light sources of the three colors of R, G, and B are generated corresponding to the three sub-pixels of R, G, and B.

With improvements in resolution of the liquid crystal display, an increase of the sub-pixels along with a decrease in the sub-pixel aperture ratio of the corresponding sub-pixels has resulted in a loss of high-resolution display transmittance and consequentially a decrease in light efficiency. Therefore, in order to balance the high resolution, transmittance, light efficiency, and backlight architecture cost of the liquid crystal display, a hybrid-color display composed of four color sub-pixels of W (White white), R, G, and B has appeared. The white sub-pixels do not contain any photoresist absorption material that absorbs visible light energy and may improve the transmittance and light efficiency of the display.

However, due to great transmittance of the white sub-pixel W, light leakage of a large view angle occurs, causing color cast and affecting the image quality in an image with a large view angle. Meanwhile, in some types of liquid crystal displays, due to the differences in full-wavelength transmittances between the front view angle and the large view angle, the optical properties, when watched in a large view angle, cannot be presented in the same correct colors as in the front view angle.

Therefore, the present inventor finds that, when a sub-pixel signal of three colors R, G, and B is used as a driver in a hybrid-color display formed by four-color sub-pixels W, R, G, and B, there is a defect of color cast in the large view angle.

SUMMARY

Based on various embodiments disclosed in this application, methods and devices for pixel signal conversion are provided.

A method for converting pixel signal is provided, comprising:

obtaining a pixel signal, wherein the pixel signal comprises an initial first sub-pixel signal, an initial second sub-pixel signal, and an initial third sub-pixel signal, and the pixel signal is adapted to correspondingly drive a red sub-pixel, a green sub-pixel, and a blue sub-pixel in a particular pixel unit obtaining each of first stimulus value signals of the initial first sub-pixel signal based on the initial first sub-pixel signal, obtaining each of second stimulus value signals of the initial second sub-pixel signal based on the initial second sub-pixel signal, and obtaining each of third stimulus value signals of the initial third sub-pixel signal based on the initial third sub-pixel signal;

determining a gain value based on a maximum value and a minimum value in a stimulus value signal set, and performing a gain processing separately on one of the first stimulus value signals, one of the second stimulus value signals, and one of the third stimulus value signals based on the gain value, wherein the stimulus value signal set comprises the one of the first stimulus value signals, the one of the second stimulus value signals, and the one of the third stimulus value signals;

obtaining a fourth sub-pixel signal based on a minimum value in the stimulus value signal set after the gain processing;

obtaining a converted first sub-pixel signal based on a difference between any one of the first stimulus value signals after the gain processing and the minimum value, obtaining a converted second sub-pixel signal based on a difference between any one of the second stimulus value signals after the gain processing and the minimum value, and obtaining a converted third sub-pixel signal based on a difference between any one of the third stimulus value signals after the gain processing and the minimum value; and using the converted first sub-pixel signal, the converted second sub-pixel signal, the converted third sub-pixel signal, and the fourth sub-pixel signal as converted pixel signals, wherein the converted pixel signals are used to correspondingly drive the red sub-pixel, the green sub-pixel, the blue sub-pixel, and a white sub-pixel in the particular pixel unit.

In an embodiment, a process of determining the gain value based on the maximum value and the minimum value in the stimulus value signal set comprises:

when the maximum value is greater than N times the minimum value, determining the gain value based on a ratio of the maximum value to a signal difference; wherein N is a value greater than 1; otherwise, setting the gain value to a preset gain value, wherein the signal difference is a ratio of the maximum value to the minimum value.

In an embodiment, a process of obtaining the fourth sub-pixel signal based on the minimum value in the stimulus value signal set after the gain processing comprises:

based on a relationship between the fourth sub-pixel signal and any one of fourth stimulus value signals of the fourth sub-pixel signal, assigning the minimum value to the any one of the fourth stimulus value signals, to obtain the fourth sub-pixel signal.

In an embodiment, the fourth stimulus value signals are a stimulus value signal WX, a stimulus value signal WY, and a stimulus value signal WZ; and the any one of the fourth stimulus value signals is the stimulus value signal WY.

In an embodiment, the first stimulus value signals are a stimulus value signal RX, a stimulus value signal RY, and a stimulus value signal RZ;

the second stimulus value signals are a stimulus value signal GX, a stimulus value signal GY, and a stimulus value signal GZ; and the third stimulus value signals are a stimulus value signal BX, a stimulus value signal BY, and a stimulus value signal BZ.

In an embodiment, the stimulus value signal set after the gain processing comprises the stimulus value signal RY after the gain processing, the stimulus value signal GY after the gain processing, and the stimulus value signal BY after the gain processing.

In an embodiment, the stimulus value signal set after the gain processing comprises the stimulus value signal RX after the gain processing, the stimulus value signal GY after the gain processing, and the stimulus value signal BZ after the gain processing.

In an embodiment, a process of obtaining each of the first stimulus value signals of the initial first sub-pixel signal based on the initial first sub-pixel signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining each of the second stimulus value signals of the initial second sub-pixel signal based on the initial second sub-pixel signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining each of the third stimulus value signals of the initial third sub-pixel signal based on the initial third sub-pixel signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein

RX is the stimulus value signal RX, RY is the stimulus value signal RY, RZ is the stimulus value signal RZ, and R is the initial first sub-pixel signal; GX is the stimulus value signal GX, GY is the stimulus value signal GY, GZ is the stimulus value signal GZ, and G is the initial second sub-pixel signal; BX is the stimulus value signal BX, BY is the stimulus value signal BY, BZ is the stimulus value signal BZ, and B is the initial third sub-pixel signal; and T is a maximum pixel signal value; and γRX, γRY, and γRZ are all stimulus value power functions of the initial first sub-pixel signal; γGX, γGY, and γGZ are all stimulus value power functions of the initial second sub-pixel signal; and γBX, γBY, and γBZ are all stimulus value power functions of the initial third sub-pixel signal.

A device for converting pixel signal is provided, comprising:

a pixel signal obtaining module, configured to obtain a pixel signal, wherein the pixel signal comprises an initial first sub-pixel signal, an initial second sub-pixel signal, and an initial third sub-pixel signal, and the pixel signal is adapted to correspondingly drive a red sub-pixel, a green sub-pixel, and a blue sub-pixel in a particular pixel unit;

a signal processing module, configured to: obtain each of first stimulus value signals of the initial first sub-pixel signal based on the initial first sub-pixel signal, obtain each of second stimulus value signals of the initial second sub-pixel signal based on the initial second sub-pixel signal, and obtain each of third stimulus value signals of the initial third sub-pixel signal based on the initial third sub-pixel signal;

a gain module, configured to: determine a gain value based on a maximum value and a minimum value in a stimulus value signal set, and perform a gain processing separately on one of the first stimulus value signals, one of the second stimulus value signals, and one of the third stimulus value signals based on the gain value, wherein the stimulus value signal set comprises the one of the first stimulus value signals, the one of the second stimulus value signals, and the one of the third stimulus value signals;

a white sub-pixel obtaining module, configured to obtain a fourth sub-pixel signal based on a minimum value in the stimulus value signal set after the gain processing;

a converted sub-pixel obtaining module, configured to: obtain a converted first sub-pixel signal based on a difference between any one of the first stimulus value signals after the gain processing and the minimum value, obtain a converted second sub-pixel signal based on a difference between any one of the second stimulus value signals after the gain processing and the minimum value, and obtain a converted third sub-pixel signal based on a difference between any one of the third stimulus value signals after the gain processing and the minimum value; and a signal conversion module, configured to use the converted first sub-pixel signal, the converted second sub-pixel signal, the converted third sub-pixel signal, and the fourth sub-pixel signal as converted pixel signals, wherein the converted pixel signals are used to correspondingly drive the red sub-pixel, the green sub-pixel, the blue sub-pixel, and a white sub-pixel in the particular pixel unit.

In an embodiment, the process of determining the gain value based on the maximum value and the minimum value in the stimulus value signal set comprises:

when the maximum value is greater than N times the minimum value, determining the gain value based on a ratio of the maximum value to a signal difference; wherein N is a value greater than 1; otherwise, setting the gain value to a preset gain value, wherein the signal difference is a ratio of the maximum value to the minimum value.

In an embodiment, the process of obtaining the fourth sub-pixel signal based on the minimum value in the stimulus value signal set after the gain processing comprises:

based on a relationship between the fourth sub-pixel signal and any one of fourth stimulus value signals of the fourth sub-pixel signal, assigning the minimum value to the any one of the fourth stimulus value signals, to obtain the fourth sub-pixel signal.

In an embodiment, the fourth stimulus value signals are a stimulus value signal WX, a stimulus value signal WY, and a stimulus value signal WZ; and the any one of the fourth stimulus value signals is the stimulus value signal WY.

In an embodiment, the first stimulus value signals are a stimulus value signal RX, a stimulus value signal RY, and a stimulus value signal RZ;

the second stimulus value signals are a stimulus value signal GX, a stimulus value signal GY, and a stimulus value signal GZ; and the third stimulus value signals are a stimulus value signal BX, a stimulus value signal BY, and a stimulus value signal BZ.

In an embodiment, the stimulus value signal set after the gain processing comprises the stimulus value signal RY after the gain processing, the stimulus value signal GY after the gain processing, and the stimulus value signal BY after the gain processing.

In an embodiment, the stimulus value signal set after the gain processing comprises the stimulus value signal RX after the gain processing, the stimulus value signal GY after the gain processing, and the stimulus value signal BZ after the gain processing.

In an embodiment, a process of obtaining each of the first stimulus value signals of the initial first sub-pixel signal based on the initial first sub-pixel signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining each of the second stimulus value signals of the initial second sub-pixel signal based on the initial second sub-pixel signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining each of the third stimulus value signals of the initial third sub-pixel signal based on the initial third sub-pixel signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein

RX is the stimulus value signal RX, RY is the stimulus value signal RY, RZ is the stimulus value signal RZ, and R is the initial first sub-pixel signal; GX is the stimulus value signal GX, GY is the stimulus value signal GY, GZ is the stimulus value signal GZ, and G is the initial second sub-pixel signal; BX is the stimulus value signal BX, BY is the stimulus value signal BY, BZ is the stimulus value signal BZ, and B is the initial third sub-pixel signal; and T is a maximum pixel signal value; and γRX, γRY, and γRZ are all stimulus value power functions of the initial first sub-pixel signal; γGX, γGY, and γGZ are all stimulus value power functions of the initial second sub-pixel signal; and γBX, γBY, and γBZ are all stimulus value power functions of the initial third sub-pixel signal.

A computer device is provided, comprising a memory and a processor, wherein the memory stores a computer program, and the processor performs the following when executing the computer program:

obtaining a pixel signal, wherein the pixel signal comprises an initial first sub-pixel signal, an initial second sub-pixel signal, and an initial third sub-pixel signal, and the pixel signal is adapted to correspondingly drive a red sub-pixel, a green sub-pixel, and a blue sub-pixel in a particular pixel unit;

obtaining each of first stimulus value signals of the initial first sub-pixel signal based on the initial first sub-pixel signal, obtaining each of second stimulus value signals of the initial second sub-pixel signal based on the initial second sub-pixel signal, and obtaining each of third stimulus value signals of the initial third sub-pixel signal based on the initial third sub-pixel signal;

determining a gain value based on a maximum value and a minimum value in a stimulus value signal set, and performing a gain processing separately on one of the first stimulus value signals, one of the second stimulus value signals, and one of the third stimulus value signals based on the gain value, wherein the stimulus value signal set comprises the one of the first stimulus value signals, the one of the second stimulus value signals and the one of the third stimulus value signals;

obtaining a fourth sub-pixel signal based on a minimum value in the stimulus value signal set after the gain processing;

obtaining a converted first sub-pixel signal based on a difference between any one of the first stimulus value signals after the gain processing and the minimum value, obtaining a converted second sub-pixel signal based on a difference between any one of the second stimulus value signals after the gain processing and the minimum value, and obtaining a converted third sub-pixel signal based on a difference between any one of the third stimulus value signals after the gain processing and the minimum value; and using the converted first sub-pixel signal, the converted second sub-pixel signal, the converted third sub-pixel signal, and the fourth sub-pixel signal as converted pixel signals, wherein the converted pixel signals are used to correspondingly drive the red sub-pixel, the green sub-pixel, the blue sub-pixel, and a white sub-pixel in the particular pixel unit.

In an embodiment, a process of determining the gain value based on the maximum value and the minimum value in the stimulus value signal set comprises:

when the maximum value is greater than N times the minimum value, determining the gain value based on a ratio of the maximum value to a signal difference; wherein, N is a value greater than 1; otherwise, setting the gain value to a preset gain value, wherein the signal difference is a ratio of the maximum value to the minimum value.

In an embodiment, a process of obtaining the fourth sub-pixel signal based on the minimum value in the stimulus value signal set after the gain processing comprises:

based on a relationship between the fourth sub-pixel signal and any one of fourth stimulus value signals of the fourth sub-pixel signal, assigning the minimum value to the any one of the fourth stimulus value signals, to obtain the fourth sub-pixel signal. In an embodiment, the fourth stimulus value signals are a stimulus value signal WX, a stimulus value signal WY, and a stimulus value signal WZ; and the any one of the fourth stimulus value signals is the stimulus value signal WY.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

The above objects, features and advantages of the present invention will become more apparent by describing in detail with reference to the accompanying drawings and embodiments. It should be understood that the specific embodiments described herein are intended only to illustrate this application and are not intended to limit this application.

This application provides a method for converting pixel signal.

Figure 1:
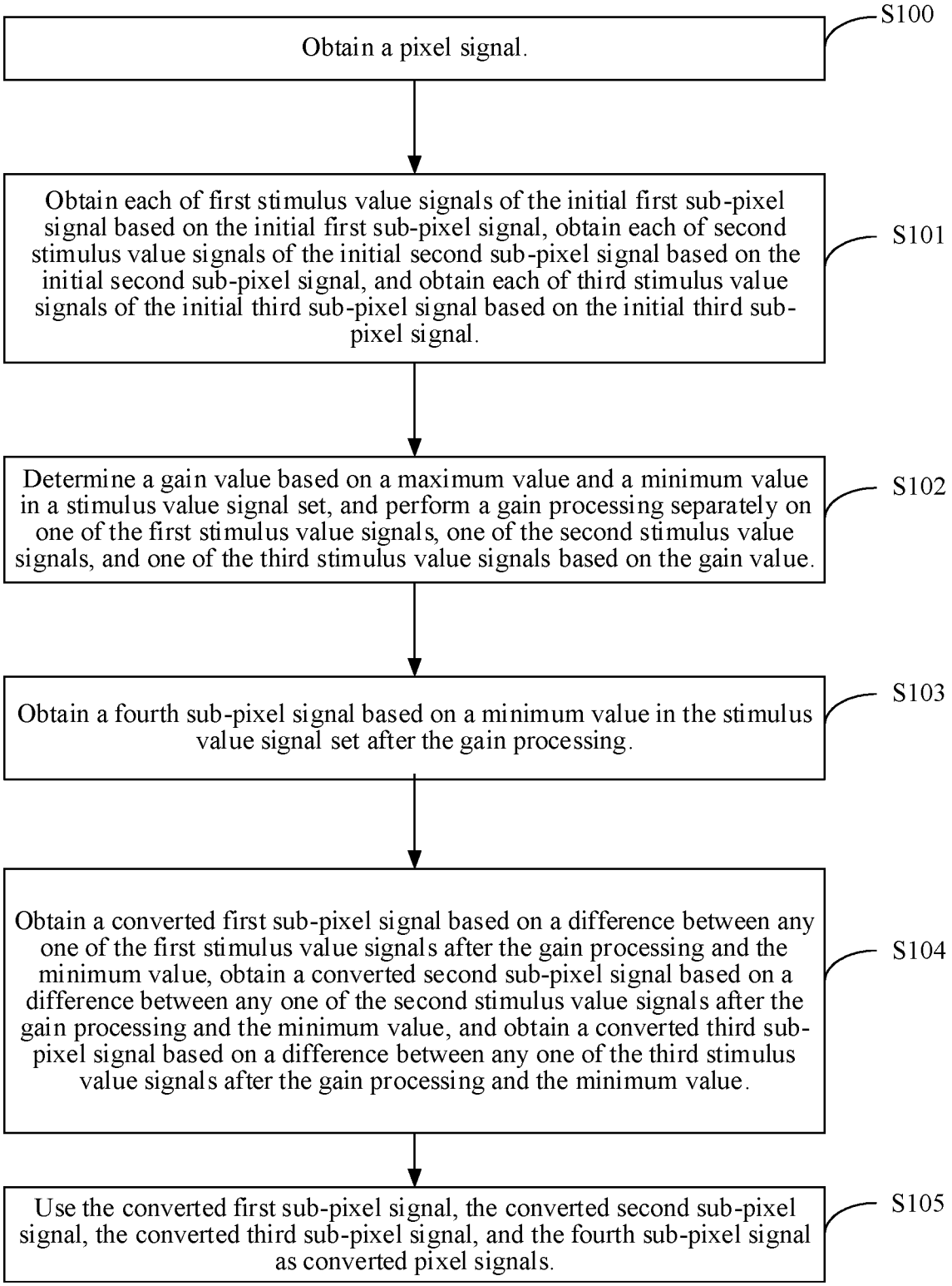
FIG. 1 shows a schematic flowchart of a method for converting pixel signal according to one or more embodiments.

FIG. 1 shows a schematic flowchart of a method for converting pixel signal according to one or more embodiments. As shown in FIG. 1, the method for converting pixel signal may comprise steps S100 to S105:

S100: obtaining a pixel signal, wherein the pixel signal may comprise an initial first sub-pixel signal, an initial second sub-pixel signal, and an initial third sub-pixel signal; and in an embodiment, the pixel signal may be adapted to correspondingly drive a red sub-pixel, a green sub-pixel, and a blue sub-pixel in a particular pixel unit.

In an embodiment, the first sub-pixel signal may be a sub-pixel R signal, the second sub-pixel signal may be a sub-pixel G signal, the third sub-pixel signal may be a sub-pixel B signal, and the fourth sub-pixel may be a sub-pixel W signal.

Figure 2:
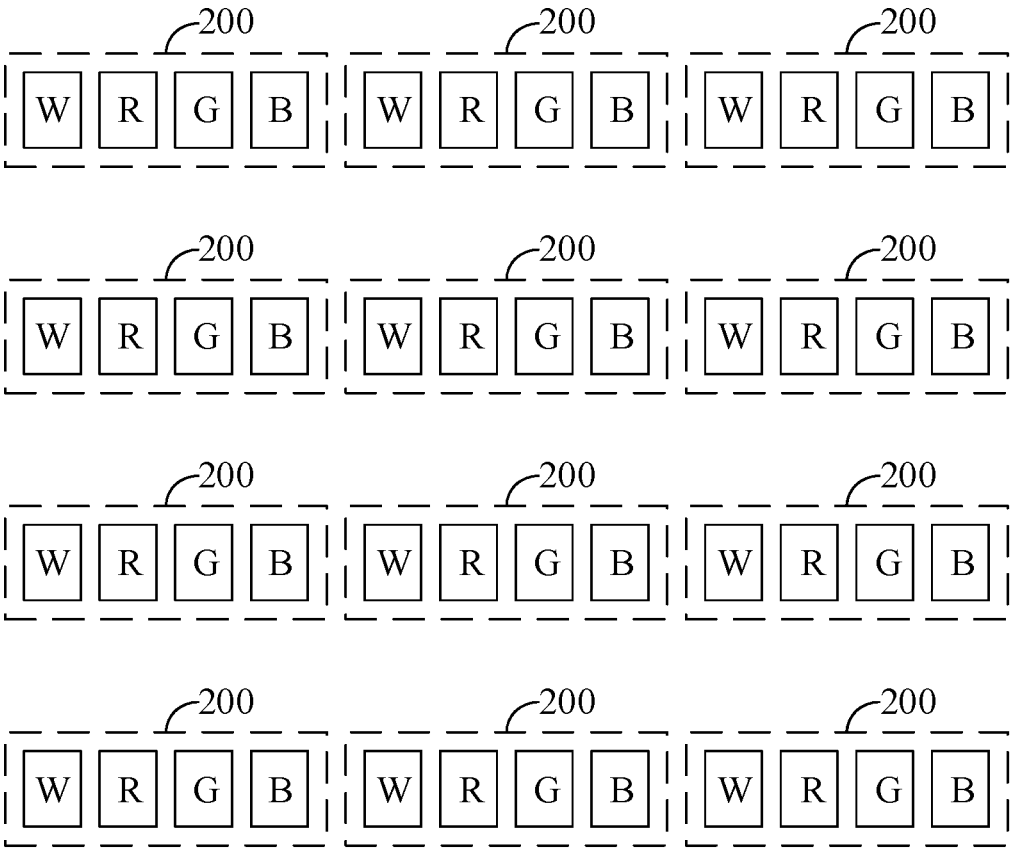
FIG. 2 shows a schematic diagram of a four-color display array.

In an embodiment, FIG. 2 shows a schematic diagram of a four-color display array. As shown in FIG. 2, the four-color display array may comprise a plurality of four-color pixel units 200 arranged in rows and columns, and each four-color pixel unit 200 may comprise four sub-pixels, that is, a red sub-pixel R, a green sub-pixel G, a blue sub-pixel B, and a sub-pixel W (white). A traditional three-color display array may comprise a plurality of three-color pixel units arranged in rows and columns, and each three-color pixel unit may comprise only three sub-pixels, that is, the red sub-pixel, the green sub-pixel, and the blue sub-pixel. In an embodiment, the particular pixel unit may be any pixel unit in the four-color display array shown in FIG. 2. The pixel signal before conversion obtained in step S100 may be adapted to correspondingly drive the red sub-pixel, the green sub-pixel, and the blue sub-pixel in the particular pixel unit, to change brightness of the correspondingly driven sub-pixel. Specifically, the initial first sub-pixel signal drives the red sub-pixel, the initial second sub-pixel signal drives the green sub-pixel, and the initial third sub-pixel signal drives the blue sub-pixel.

S101: obtain each of first stimulus value signals of the initial first sub-pixel signal based on the initial first sub-pixel signal, obtain each of second stimulus value signals of the initial second sub-pixel signal based on the initial second sub-pixel signal, and obtain each of third stimulus value signals of the initial third sub-pixel signal based on the initial third sub-pixel signal.

The pixel signal may comprise three sub-pixel signals, that is, the initial first sub-pixel signal, the initial second sub-pixel signal, and the initial third sub-pixel signal. In an embodiment, each sub-pixel signal corresponds to a stimulus value signal based on optical brightness. It should be noted that a sub-pixel signal may correspond to a plurality of stimulus value signals. Specifically, a stimulus value signal corresponding to the initial first sub-pixel signal may be the first stimulus value signal, a stimulus value signal corresponding to the initial second sub-pixel signal may be the second stimulus value signal, and a stimulus value signal corresponding to the initial third sub-pixel signal may be the third stimulus value signal.

In an embodiment, the first stimulus value signals may be a stimulus value signal RX, a stimulus value signal RY, and a stimulus value signal RZ; and the second stimulus value signals may be a stimulus value signal GX, a stimulus value signal GY, and a stimulus value signal GZ; and the third stimulus value signals may be a stimulus value signal BX, a stimulus value signal BY, and a stimulus value signal BZ.

Correspondingly, a process of obtaining each of the first stimulus value signals of the initial first sub-pixel signal based on the initial first sub-pixel signal may be represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining each of the second stimulus value signals of the initial second sub-pixel signal based on the initial second sub-pixel signal may be represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining each of the third stimulus value signals of the initial third sub-pixel signal based on the initial third sub-pixel signal may be represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases}.$$

In an embodiment, RX may be the stimulus value signal RX, RY may be the stimulus value signal RY, RZ may be the stimulus value signal RZ, and R may be the initial first sub-pixel signal; GX may be the stimulus value signal GX, GY may be the stimulus value signal GY, GZ may be the stimulus value signal GZ, and G may be the initial second sub-pixel signal; BX may be the stimulus value signal BX, BY may be the stimulus value signal BY, BZ may be the stimulus value signal BZ, and B may be the initial third sub-pixel signal; and T may be a maximum pixel signal value.

In an embodiment, the maximum pixel signal value depends on the type of a displayed image. For example, when an 8-bit greyscale digital image is displayed, the maximum pixel signal value is $2^8-1=255$.

In an embodiment, γRX, γRY, and γRZ may be all stimulus value power functions of the initial first sub-pixel signal; γGX, γGY, and γGZ may be all stimulus value power functions of the initial second sub-pixel signal; and γBX, γBY, and γBZ may be all stimulus value power functions of the initial third sub-pixel signal.

Figure 3:
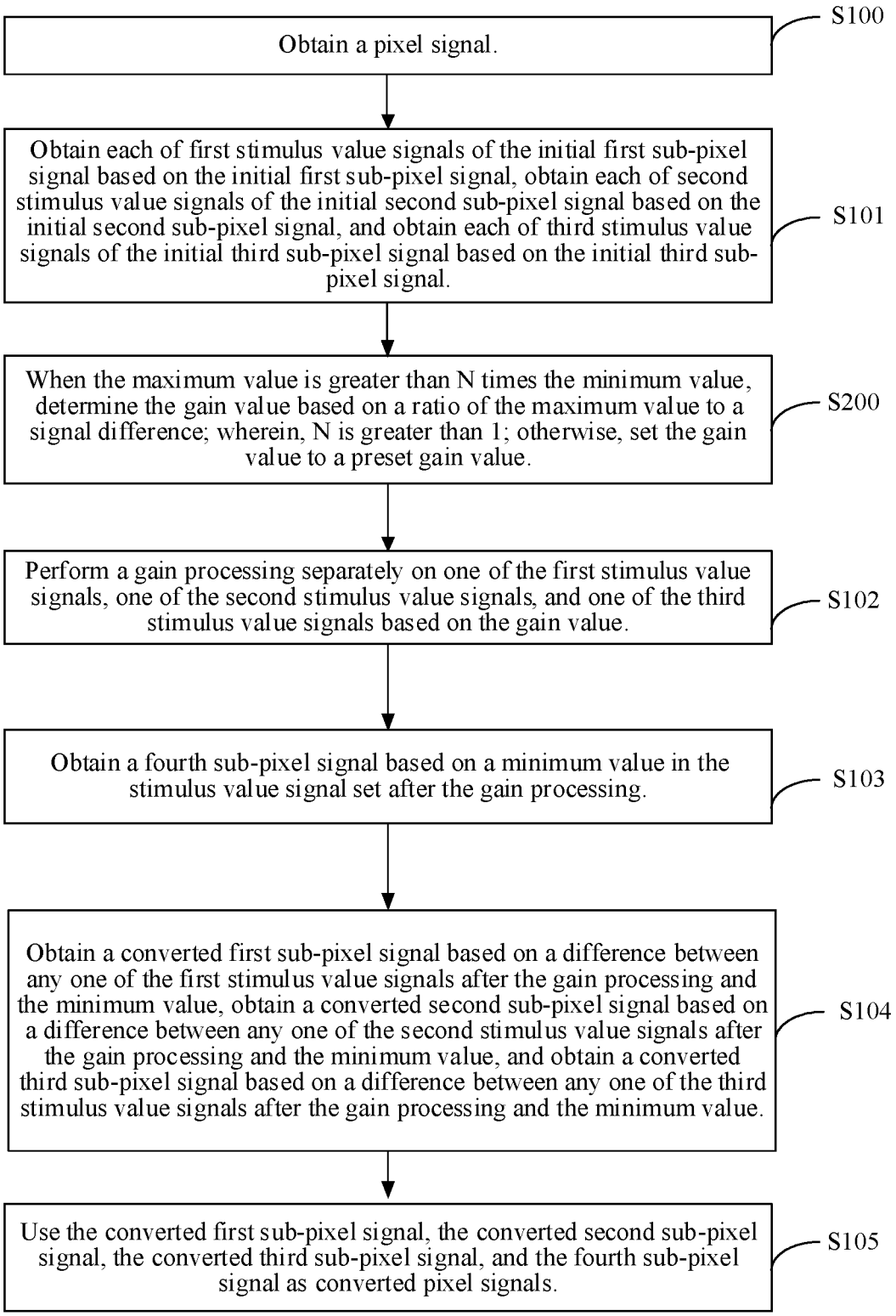
FIG. 3 shows a flowchart of another method for converting pixel signal according to one or more embodiments.

In an embodiment, FIG. 3 shows a flowchart of another method for converting pixel signal according to one or more embodiments. As shown in FIG. 3, a process of determining the gain value based on the maximum value and the minimum value in a stimulus value signal set in step S101 may comprise step S200:

S200: when the maximum value is greater than N times the minimum value, determine the gain value based on a ratio of the maximum value to a signal difference; wherein N is a value greater than 1; otherwise, set the gain value to a preset gain value, wherein in an embodiment, the signal difference may be a ratio of the maximum value to the minimum value.

It may be assumed that the maximum value is max and the minimum value is min. That is, when max>N*min, the gain value G=K*max/(max−min)+A. In an embodiment, A may be a constant and K may be a proportional coefficient. When max<N*min, the gain value may be the preset gain value. Generally, in a preferred embodiment, the preset gain value may be 2.

In an embodiment, as described above, the first stimulus value signal may comprise RX, RY, and RZ. Gain processing may be performed on the first stimulus value signal. For example, the preset gain value may be 2. As a result, the first stimulus value signal after the gain processing may be two times the original stimulus value signal, that is, 2RX, 2RY, and 2RZ. Similarly, the second stimulus value signal after the doubling gain processing may be 2GX, 2GY, and 2GZ. The third stimulus value signal after the doubling gain processing may be 2BX, 2BY, and 2BZ. In an embodiment, it should be noted that the preset gain value may comprise, but is not limited to, 2.

S102: determine a gain value based on a maximum value and a minimum value in a stimulus value signal set, and perform a gain processing separately on one of the first stimulus value signals, one of the second stimulus value signals, and one of the third stimulus value signals based on the gain value, wherein in an embodiment, the stimulus value signal set may comprise the one of the first stimulus value signals, the one of the second stimulus value signals, and the one of the third stimulus value signals.

In an embodiment, the stimulus value signal set may comprise the stimulus value signal RY, the stimulus value signal GY, and the stimulus value signal BY.

Figure 4:
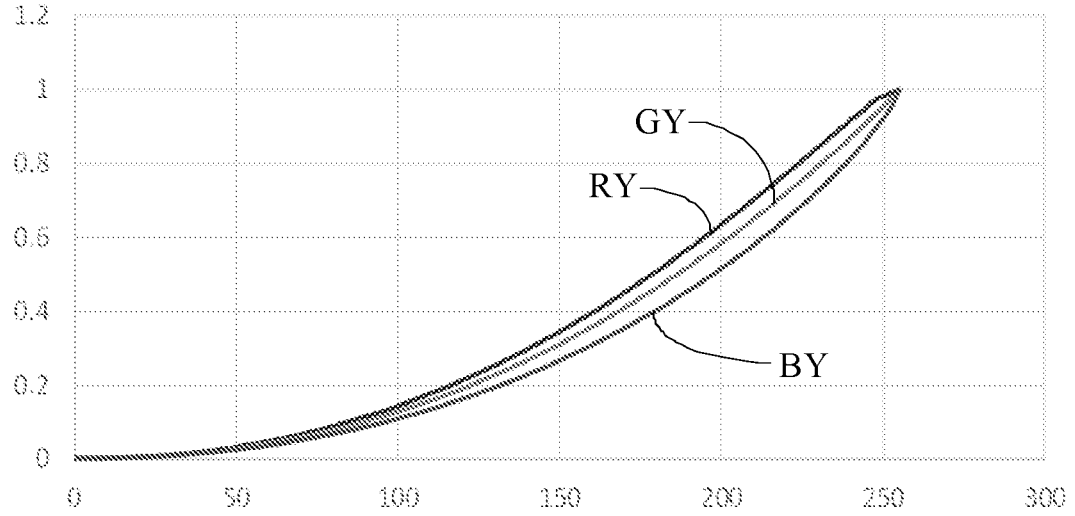
FIG. 4 shows a schematic diagram of a curve of a stimulus value signal set according to one or more embodiments.

Assuming that the stimulus value signal set is U1, then U1=(RY, GY, BY). FIG. 4 shows a schematic diagram of a curve of a stimulus value signal set according to one or more embodiments. As shown in FIG. 4, the x-axis direction shows a sub-pixel signal, and the y-axis direction shows a stimulus value signal. Variation of the stimulus value signal in the stimulus value signal set along with the sub-pixel signal may be characterized as shown in FIG. 3. In an embodiment, in the stimulus value signal set the minimum value Min1=min(RY, GY, BY) and the maximum value Max1=max(RY, GY, BY). It should be noted that after the doubling gain processing, U1=(2RY, 2GY, 2BY).

In an embodiment, the stimulus value signal set may comprise the stimulus value signal RX, the stimulus value signal GY, and the stimulus value signal BZ.

Figure 5:
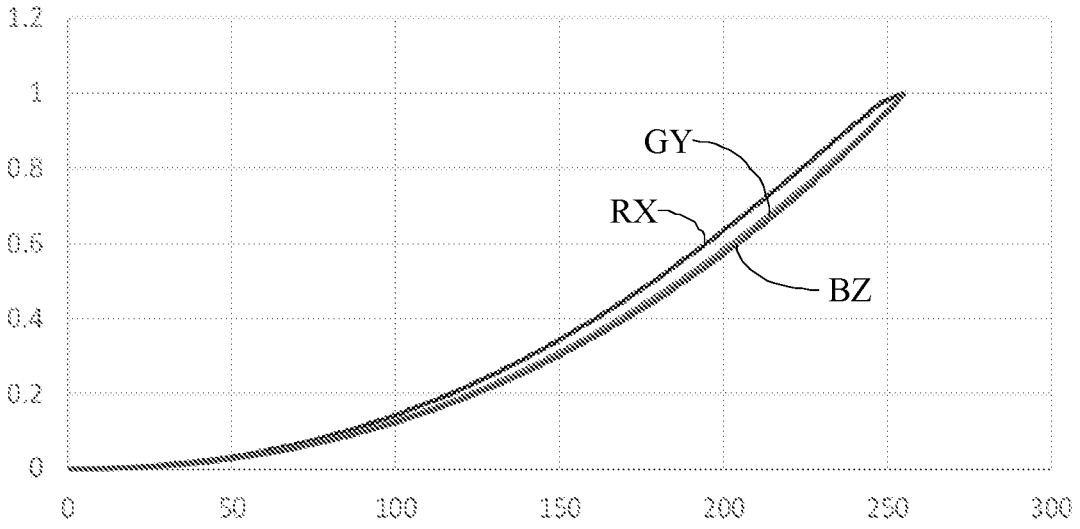
FIG. 5 shows a schematic diagram of a curve of another stimulus value signal set according to one or more embodiments.

Assuming that the stimulus value signal set is U2, then U2=(RX, GY, BZ), and the maximum value Max2=max (RX, GY, BZ). It should be noted that after the doubling gain processing, U2=(2RX, 2GY, 2BZ). FIG. 5 shows a schematic diagram of a curve of another stimulus value signal set according to one or more embodiments. As shown in FIG. 5, the x-axis direction indicates a sub-pixel signal and the y-axis direction indicates a stimulus value signal. Variation of a stimulus value signal in the stimulus value signal set along with the sub-pixel signal may be characterized as in FIG. 4. In an embodiment, as shown in FIG. 4, in a comparison between the stimulus value signal set U2 and the stimulus value signal set U1, proportional weights of stimulus value signals in the stimulus value signal set U2 may be closer to each other, so that a subsequently converted sub-pixel signal may be closer to actual representation of original R, G, B mixed-colors.

In an embodiment, a minimum value in the stimulus value signal set after the gain processing Min2=min(2RX, 2GY, 2BZ).

S103: obtain a fourth sub-pixel signal based on a minimum value in the stimulus value signal set after the gain processing.

Figure 6:
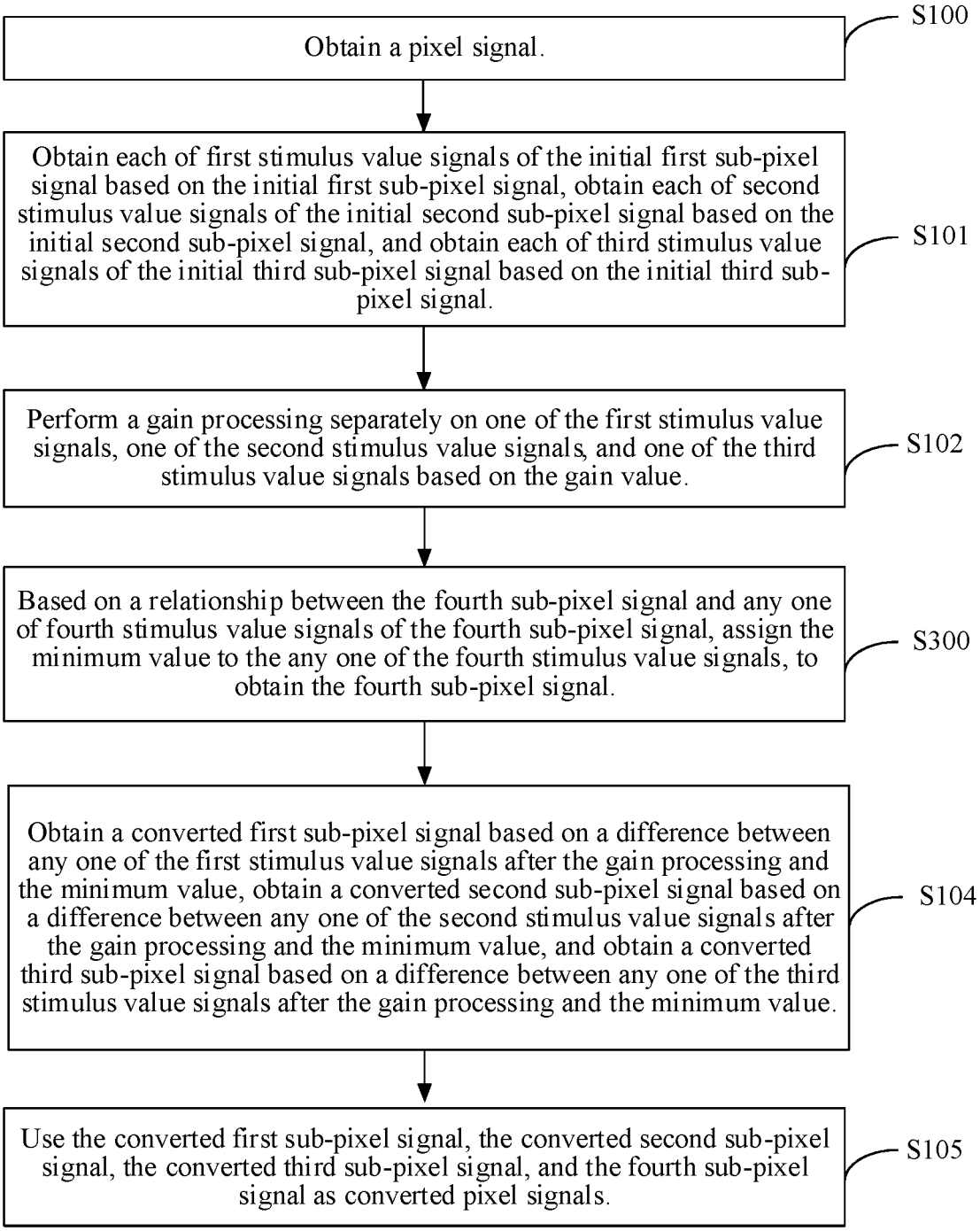
FIG. 6 shows a flowchart of another method for converting pixel signal according to one or more embodiments.

FIG. 6 shows a flowchart of another method for converting pixel signal according to one or more embodiments herein. As shown in FIG. 6, a process of obtaining the fourth sub-pixel signal based on the minimum value in the stimulus value signal set after the gain processing in step S103 may comprise step S300:

S300: Based on a relationship between the fourth sub-pixel signal and any one of fourth stimulus value signals of the fourth sub-pixel signal, assign the minimum value to the any one of the fourth stimulus value signals, to obtain the fourth sub-pixel signal.

In an embodiment, correspondingly, the fourth sub-pixel signals also may comprise a stimulus value signal WX, a stimulus value signal WY, and a stimulus value signal WZ. In an embodiment, a relationship between the fourth subpixel signal and each stimulus value signal corresponding to the fourth sub-pixel signal may be shown in the following formula:

$$\begin{cases} WX = (W/T)^{\wedge\gamma WX} \\ WY = (W/T)^{\wedge\gamma WY} \\ WZ = (W/T)^{\wedge\gamma WZ} \end{cases}.$$

In an embodiment, WX may be the stimulus value signal WX, WY may be the stimulus value signal WY, WZ may be the stimulus value signal WZ, W may be the fourth sub-pixel signal, and T may be the maximum pixel signal value. γWX, γWY, and γWZ may be all stimulus value power functions of the fourth sub-pixel signal.

Correspondingly, after the stimulus value signal of the fourth sub-pixel signal is determined, the fourth sub-pixel signal may be obtained by using the following formula:

$$\begin{cases} W = WX^{\wedge(1/\gamma WX)} * 255 \\ W = WY^{\wedge(1/\gamma WY)} * 255 \\ W = WZ^{\wedge(1/\gamma WZ)} * 255 \end{cases}.$$

In an embodiment, WX may be the stimulus value signal WX, WY may be the stimulus value signal WY, WZ may be the stimulus value signal WZ, W may be the fourth sub-pixel signal, and T may be the maximum pixel signal value. γWX, γWY, and γWZ may be all stimulus value power functions of the fourth sub-pixel signal.

In an embodiment, the any one of the fourth stimulus value signals may be the stimulus value signal WY.

S104: obtain a converted first sub-pixel signal based on a difference between any one of the first stimulus value signals after the gain processing and the minimum value, obtain a converted second sub-pixel signal based on a difference between any one of the second stimulus value signals after the gain processing and the minimum value, and obtain a converted third sub-pixel signal based on a difference between any one of the third stimulus value signals after the gain processing and the minimum value.

In an embodiment, for example, any one of the first stimulus value signals after the gain processing may be a stimulus value signal RY'=G*RY, and the converted first sub-pixel signal may be shown in the following formula:

$$\overline{R}=(RY'-\min)^{\wedge(1/\gamma RY)}*255.$$

In an embodiment, $\overline{R}$ may be the converted first sub-pixel signal, min may be the minimum value, and γRX may be a stimulus value power function of the initial first sub-pixel signal.

Similarly, the converted second sub-pixel signal and the converted third sub-pixel signal may be obtained.

S105: use the converted first sub-pixel signal, the converted second sub-pixel signal, the converted third sub-pixel signal, and the fourth sub-pixel signal as converted pixel signals, wherein in an embodiment, the converted pixel signals may be adapted to correspondingly drive the red sub-pixel, the green sub-pixel, the blue sub-pixel, and a white sub-pixel in the particular pixel unit.

In an embodiment, the converted pixel signals comprise the converted first sub-pixel signal, the converted second sub-pixel signal, the converted third sub-pixel signal, and the fourth sub-pixel signal. Correspondingly, as shown in FIG. 2, the converted first sub-pixel signal drives the red sub-pixel, the converted second sub-pixel signal drives the green sub-pixel, the converted third sub-pixel signal drives the blue sub-pixel, and the fourth sub-pixel signal drives the white sub-pixel.

In the method for converting pixel signal, the corresponding first stimulus value signal, second stimulus value signal, and third stimulus value signal may be obtained based on the initial first sub-pixel signal, the initial second sub-pixel signal, and the initial third sub-pixel signal of the pixel signal. Further, the gain processing may be performed on the first stimulus value signal, the second stimulus value signal, and the third stimulus value signal based on a maximum value and a minimum value in a stimulus value signal set, and a fourth sub-pixel signal may be obtained based on the minimum value of the stimulus value signals after the gain processing. A converted first sub-pixel signal, a converted second sub-pixel signal, and a converted third sub-pixel signal may be obtained consequentially. Finally, the converted first sub-pixel signal, the converted second sub-pixel signal, the converted third sub-pixel signal, and the fourth sub-pixel signal may be used as the converted pixel signals. On this basis, when the converted pixel signals may be applied to a hybrid-color display consisting of sub-pixels of four colors of W, R, G, and B, a display effect may be closer to the actual representation of original hybrid colors of R, G, and B, to alleviate a color cast defect of a large view angle and improve a display effect.

This application provides a device for converting pixel signal.

Figure 7:
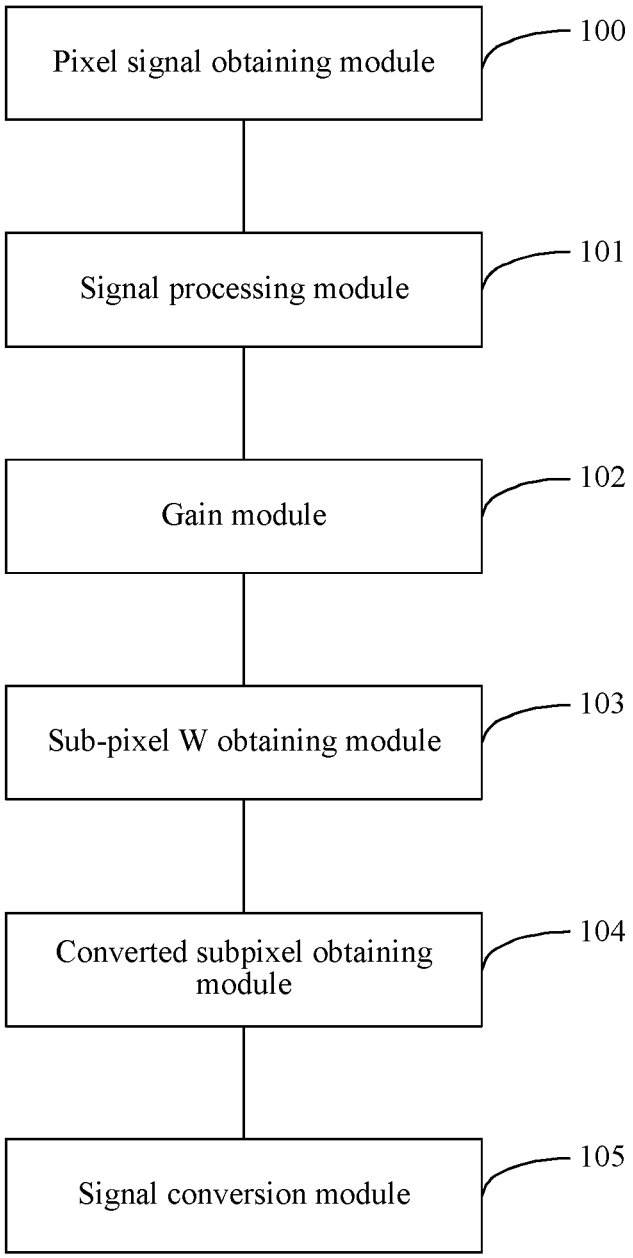
FIG. 7 shows a structural diagram of modules of a device for converting pixel signal according to one or more embodiments.

FIG. 7 shows a module structural diagram of a device for converting pixel signal according to one or more embodiments. As shown in FIG. 7, the apparatus for converting pixel signal may comprise the following modules 100 to 105:

a pixel signal obtaining module 100 configured to obtain a pixel signal, wherein the pixel signal may comprise an initial first sub-pixel signal, an initial second sub-pixel signal, and an initial third sub-pixel signal, and in an embodiment, the pixel signal may be adapted to correspondingly drive a red sub-pixel, a green sub-pixel, and a blue sub-pixel in a particular pixel unit;

a signal processing module 101 configured to: obtain each of first stimulus value signals of the initial first sub-pixel signal based on the initial first sub-pixel signal, obtain each of second stimulus value signals of the initial second sub-pixel signal based on the initial second sub-pixel signal, and obtain each of third stimulus value signals of the initial third sub-pixel signal based on the initial third sub-pixel signal;

a gain module 102 may be configured to: determine a gain value based on a maximum value and a minimum value in a stimulus value signal set, and perform a gain processing separately on one of the first stimulus value signals, one of the second stimulus value signals, and one of the third stimulus value signals based on the gain value, wherein in an embodiment, the stimulus value signal set may comprise the one of the first stimulus value signals, the one of the second stimulus value signals, and the one of the third stimulus value signals;

wherein, in an embodiment, the gain module 102 may be specifically configured to: when the maximum value is greater than N times the minimum value, determine the gain value based on a ratio of the maximum value to a signal difference; wherein, N is a value greater than 1; otherwise, set the gain value to a preset gain value, wherein in an embodiment, the signal difference may be a ratio of the maximum value to the minimum value;

a white sub-pixel obtaining module 103 configured to obtain a fourth sub-pixel signal based on a minimum value in the stimulus value signal set after the gain processing;

wherein, in an embodiment, the white sub-pixel obtaining module 102 may be specifically configured to, based on a relationship between the fourth sub-pixel signal and any one of fourth stimulus value signals of the fourth sub-pixel signal, assign the minimum value to the any one of the fourth stimulus value signals, to obtain the fourth sub-pixel signal;

a converted sub-pixel obtaining module 104 may be configured to: obtain a converted first sub-pixel signal based on a difference between any one of the first stimulus value signals after the gain processing and the minimum value, obtain a converted second sub-pixel signal based on a difference between any one of the second stimulus value signals after the gain processing and the minimum value, and obtain a converted third sub-pixel signal based on a difference between any one of the third stimulus value signals after the gain processing and the minimum value; and a signal conversion module 105 configured to use the converted first sub-pixel signal, the converted second sub-pixel signal, the converted third sub-pixel signal, and the fourth sub-pixel signal as converted pixel signals, wherein in an embodiment, the converted pixel signals may be adapted to correspondingly drive the red sub-pixel, the green sub-pixel, the blue sub-pixel, and a white sub-pixel in the particular pixel unit.

The above-mentioned device for converting pixel signal may obtain the corresponding first stimulus value signal, second stimulus value signal, and third stimulus value signal based on the initial first sub-pixel signal, the initial second sub-pixel signal, and the initial third sub-pixel signal of the pixel signal. Further, the gain processing may be performed on the first stimulus value signal, the second stimulus value signal, and the third stimulus value signal based on a maximum value and a minimum value in a stimulus value signal set, and a fourth sub-pixel signal may be obtained based on the minimum value of the stimulus value signals after the gain processing. As a result, converted first sub-pixel signal, a converted second sub-pixel signal, and a converted third sub-pixel signal may be obtained. Finally, the converted first sub-pixel signal, the converted second sub-pixel signal, the converted third sub-pixel signal, and the fourth sub-pixel signal may be used as the converted pixel signals. On this basis, when the converted pixel signals may be applied to a hybrid-color display consisting of sub-pixels of four colors of W, R, G, and B, a display effect may be closer to the actual representation of original hybrid colors of R, G, and B, to alleviate a color cast defect of a large view angle and improve a display effect.

In an embodiment, a computer device may be provided, comprising a memory and a processor, wherein the memory stores a computer program, and the processor performs the following when executing the computer program:

obtaining a pixel signal, wherein the pixel signal may comprise an initial first sub-pixel signal, an initial second sub-pixel signal, and an initial third sub-pixel signal, and in an embodiment, the pixel signal may be adapted to correspondingly drive a red sub-pixel, a green sub-pixel, and a blue sub-pixel in a particular pixel unit;

obtaining each of first stimulus value signals of the initial first sub-pixel signal based on the initial first sub-pixel signal, obtaining each of second stimulus value signals of the initial second sub-pixel signal based on the initial second sub-pixel signal, and obtaining each of the third stimulus value signals of the initial third sub-pixel signal based on the initial third sub-pixel signal;

determining a gain value based on a maximum value and a minimum value in a stimulus value signal set, and performing a gain processing separately on one of the first stimulus value signals, one of the second stimulus value signals, and one of the third stimulus value signals based on the gain value, wherein in an embodiment, the stimulus value signal set may comprise the one of the first stimulus value signals, the one of the second stimulus value signals, and the one of the third stimulus value signals;

obtaining a fourth sub-pixel signal based on a minimum value in the stimulus value signal set after the gain processing;

obtaining a converted first sub-pixel signal based on a difference between any one of the first stimulus value signals after the gain processing and the minimum value, obtaining a converted second sub-pixel signal based on a difference between any one of the second stimulus value signals after the gain processing and the minimum value, and obtaining a converted third sub-pixel signal based on a difference between any one of the third stimulus value signals after the gain processing and the minimum value; and using the converted first sub-pixel signal, the converted second sub-pixel signal, the converted third sub-pixel signal, and the fourth sub-pixel signal as converted pixel signals, wherein in an embodiment, the converted pixel signals may be adapted to correspondingly drive the red sub-pixel, the green sub-pixel, the blue sub-pixel, and a white sub-pixel in the particular pixel unit.

The above-mentioned computer device may obtain the corresponding first stimulus value signal, second stimulus value signal, and third stimulus value signal based on the initial first sub-pixel signal, the initial second sub-pixel signal, and the initial third sub-pixel signal of the pixel signal. Further, the gain processing may be performed on the first stimulus value signal, the second stimulus value signal, and the third stimulus value signal based on a maximum value and a minimum value in a stimulus value signal set, a fourth sub-pixel signal may be obtained based on the minimum value of the stimulus value signals after the gain processing. A converted first sub-pixel signal, a converted second sub-pixel signal, and a converted third sub-pixel signal may be obtained consequentially. Finally, the converted first sub-pixel signal, the converted second sub-pixel signal, the converted third sub-pixel signal, and the fourth sub-pixel signal may be used as the converted pixel signals. On this basis, when the converted pixel signals may be applied to a hybrid-color display consisting of sub-pixels of four colors of W, R, G, and B, the display effect may be closer to actual representation of original hybrid colors of R, G, and B, to alleviate a color cast defect of a large view angle and improve the display effect.

In an embodiment, a computer-readable storage medium may be provided, and stores a computer program. wherein the following is performed when executing the computer program by a processor When executing the computer program:

obtaining a pixel signal, wherein the pixel signal may comprise an initial first sub-pixel signal, an initial second sub-pixel signal, and an initial third sub-pixel signal, and in an embodiment, the pixel signal may be adapted to correspondingly drive a red sub-pixel, a green sub-pixel, and a blue sub-pixel in a particular pixel unit;

obtaining each of first stimulus value signals of the initial first sub-pixel signal based on the initial first sub-pixel signal, obtaining each of second stimulus value signals of the initial second sub-pixel signal based on the initial second sub-pixel signal, and obtaining each of third stimulus value signals of the initial third sub-pixel signal based on the initial third sub-pixel signal;

determining a gain value based on a maximum value and a minimum value in a stimulus value signal set, and performing a gain processing separately on one of the first stimulus value signals, one of the second stimulus value signals, and one of the third stimulus value signals based on the gain value, wherein in an embodiment, the stimulus value signal set may comprise the one of the first stimulus value signals, the one of the second stimulus value signals, and the one of the third stimulus value signals;

obtaining a fourth sub-pixel signal based on a minimum value in the stimulus value signal set after the gain processing;

obtaining a converted first sub-pixel signal based on a difference between any one of the first stimulus value signals after the gain processing and the minimum value, obtaining a converted second sub-pixel signal based on a difference between any one of the second stimulus value signals after the gain processing and the minimum value, and obtaining a converted third sub-pixel signal based on a difference between any one of the third stimulus value signals after the gain processing and the minimum value; and using the converted first sub-pixel signal, the converted second sub-pixel signal, the converted third sub-pixel signal, and the fourth sub-pixel signal as converted pixel signals, wherein in an embodiment, the converted pixel signals may be adapted to correspondingly drive the red sub-pixel, the green sub-pixel, the blue sub-pixel, and a white sub-pixel in the particular pixel unit.

The above-mentioned computer readable storage medium may obtain the corresponding first stimulus value signal, second stimulus value signal, and third stimulus value signal based on the initial first sub-pixel signal, the initial second sub-pixel signal, and the initial third sub-pixel signal of the pixel signal. Further, the gain processing may be performed on the first stimulus value signal, the second stimulus value signal, and the third stimulus value signal based on a maximum value and a minimum value in a stimulus value signal set. A fourth sub-pixel signal may be obtained based on the minimum value of the stimulus value signals after the gain processing, and a converted first sub-pixel signal, a converted second sub-pixel signal, and a converted third sub-pixel signal may be obtained consequentially. Finally, the converted first sub-pixel signal, the converted second sub-pixel signal, the converted third sub-pixel signal, and the fourth sub-pixel signal may be used as the converted pixel signals. On this basis, when the converted pixel signals are applied to a hybrid-color display consisting of sub-pixels of four colors of W, R, G, and B, a display effect may be closer to actual representation of original hybrid colors of R, G, and B, to alleviate a color cast defect of a large view angle and improve a display effect.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A method for converting pixel signal, comprising:

obtaining a pixel signal, wherein the pixel signal comprises an initial first sub-pixel signal, an initial second sub-pixel signal, and an initial third sub-pixel signal, and wherein the pixel signal is adapted to correspondingly drive a red sub-pixel, a green sub-pixel, and a blue sub-pixel in a pixel unit;

obtaining first stimulus value signals of the initial first sub-pixel signal based on the initial first sub-pixel signal, obtaining second stimulus value signals of the initial second sub-pixel signal based on the initial second sub-pixel signal, and obtaining each of third stimulus value signals of the initial third sub-pixel signal based on the initial third sub-pixel signal;

determining a gain value based on a maximum value and a minimum value in a stimulus value signal set, and performing a gain processing separately on one of the first stimulus value signals, one of the second stimulus value signals, and one of the third stimulus value signals based on the gain value, wherein the stimulus value signal set comprises the one of the first stimulus value signals, the one of the second stimulus value signals, and the one of the third stimulus value signals;

obtaining a fourth sub-pixel signal based on the minimum value in the stimulus value signal set after the gain processing;

obtaining a converted first sub-pixel signal based on a difference between any one of the first stimulus value signals after the gain processing and the minimum value, obtaining a converted second sub-pixel signal based on a difference between any one of the second stimulus value signals after the gain processing and the minimum value, and obtaining a converted third sub-pixel signal based on a difference between any one of the third stimulus value signals after the gain processing and the minimum value; and using the converted first sub-pixel signal, the converted second sub-pixel signal, the converted third sub-pixel signal, and the fourth sub-pixel signal as converted pixel signals, wherein the converted pixel signals are used to correspondingly drive the red sub-pixel, the green sub-pixel, the blue sub-pixel, and a white sub-pixel in the pixel unit.

2. The method for converting pixel signal according to claim 1, wherein the step of determining a gain value based on the maximum value and the minimum value in the stimulus value signal set comprises:

when the maximum value is greater than N times the minimum value and N is a value greater than 1, determining the gain value based on a ratio of the maximum value to a signal difference; otherwise, setting the gain value to a preset gain value, wherein the signal difference is a ratio of the maximum value to the minimum value.

3. The method for converting pixel signal according to claim 1, wherein of the step of obtaining a fourth sub-pixel signal based on the minimum value in the stimulus value signal set after the gain processing comprises:

assigning the minimum value to any one of fourth stimulus value signals, based on a relationship between the fourth sub-pixel signal and the any one of the fourth stimulus value signals of the fourth sub-pixel signal.

4. The method for converting pixel signal according to claim 3, wherein the fourth stimulus value signals are a stimulus value signal WX, a stimulus value signal WY, and a stimulus value signal WZ, and wherein the any one of the fourth stimulus value signals is the stimulus value signal WY.

5. The method for converting pixel signal according to claim 1, wherein the first stimulus value signals are a stimulus value signal RX, a stimulus value signal RY, and a stimulus value signal RZ, wherein the second stimulus value signals are a stimulus value signal GX, a stimulus value signal GY, and a stimulus value signal GZ, and wherein the third stimulus value signals are a stimulus value signal BX, a stimulus value signal BY, and a stimulus value signal BZ.

6. The method for converting pixel signal according to claim 5, wherein the stimulus value signal set after the gain processing comprises the stimulus value signal RY after the gain processing, the stimulus value signal GY after the gain processing, and the stimulus value signal BY after the gain processing.

7. The method for converting pixel signal according to claim 5, wherein the stimulus value signal set after the gain processing comprises the stimulus value signal RX after the gain processing, the stimulus value signal GY after the gain processing, and the stimulus value signal BZ after the gain processing.

8. The method for converting pixel signal according to claim 5, wherein the step of obtaining first stimulus value signals of the initial first sub-pixel signal based on the initial first sub-pixel signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

wherein the step of obtaining second stimulus value signals of the initial second sub-pixel signal based on the initial second sub-pixel signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and wherein the step of obtaining third stimulus value signals of the initial third sub-pixel signal based on the initial third sub-pixel signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein RX is the stimulus value signal RX, RY is the stimulus value signal RY, RZ is the stimulus value signal RZ, and R is the initial first sub-pixel signal, wherein GX is the stimulus value signal GX, GY is the stimulus value signal GY, GZ is the stimulus value signal GZ, and G is the initial second sub-pixel signal, wherein BX is the stimulus value signal BX, BY is the stimulus value signal BY, BZ is the the initial third sub-pixel signal, wherein T is a maximum pixel signal value, wherein γRX, γRY, and γRZ are stimulus value power functions of the initial first sub-pixel signal, wherein γGX, γGY, and γGZ are stimulus value power functions of the initial second sub-pixel signal, and wherein γBX, γBY, and γBZ are stimulus value power functions of the initial third sub-pixel signal.

9. A computer device, comprising:

a memory storing a computer program; and a processor adapted to execute the computer program to cause the processor to:

obtain a pixel signal, wherein the pixel signal comprises an initial first sub-pixel signal, an initial second sub-pixel signal, and an initial third sub-pixel signal, and wherein the pixel signal is adapted to correspondingly drive a red sub-pixel, a green sub-pixel, and a blue sub-pixel in a particular pixel unit;

obtain first stimulus value signals of the initial first sub-pixel signal based on the initial first sub-pixel signal, obtaining second stimulus value signals of the initial second sub-pixel signal based on the initial second sub-pixel signal, and obtaining third stimulus value signals of the initial third sub-pixel signal based on the initial third sub-pixel signal;

determine a gain value based on a maximum value and a minimum value in a stimulus value signal set, and perform a gain processing separately on one of the first stimulus value signals, one of the second stimulus value signals, and one of the third stimulus value signals based on the gain value, wherein the stimulus value signal set comprises the one of the first stimulus value signals, the one of the second stimulus value signals, and the one of the third stimulus value signals;

obtain a fourth sub-pixel signal based on the minimum value in the stimulus value signal set after the gain processing;

obtain a converted first sub-pixel signal based on a difference between any one of the first stimulus value signals after the gain processing and the minimum value, obtain a converted second sub-pixel signal based on a difference between any one of the second stimulus value signals after the gain processing and the minimum value, and obtain a converted third sub-pixel signal based on a difference between any one of the third stimulus value signals after the gain processing and the minimum value; and use the converted first sub-pixel signal, the converted second sub-pixel signal, the converted third sub-pixel signal, and the fourth sub-pixel signal as converted pixel signals, wherein the converted pixel signals are used to correspondingly drive the red sub-pixel, the green sub-pixel, the blue sub-pixel, and a white sub-pixel in the particular pixel unit.

10. The computer device according to claim 9, wherein when the maximum value is greater than N times the minimum value and N is a value greater than 1, the gain value is determined based on a ratio of the maximum value to a signal difference; otherwise, the gain value is set to a preset gain value, wherein the signal difference is a ratio of the maximum value to the minimum value.

11. The computer device according to claim 9, wherein the minimum value is assigned to any one of fourth stimulus value signals, based on a relationship between the fourth sub-pixel signal and the any one of the fourth stimulus value signals of the fourth sub-pixel signal, to obtain the fourth sub-pixel signal.

12. The computer device according to claim 11, wherein the fourth stimulus value signals are a stimulus value signal WX, a stimulus value signal WY, and a stimulus value signal WZ, and wherein the any one of the fourth stimulus value signals is the stimulus value signal WY.

13. A computer program product comprising a non-transitory computer-readable storage medium storing a computer program which, when executed by a processor, causes the processor to:

obtain a pixel signal, wherein the pixel signal comprises an initial first sub-pixel signal, an initial second sub-pixel signal, and an initial third sub-pixel signal, and wherein the pixel signal is adapted to correspondingly drive a red sub-pixel, a green sub-pixel, and a blue sub-pixel in a pixel unit;

obtain first stimulus value signals of the initial first sub-pixel signal based on the initial first sub-pixel signal, obtain second stimulus value signals of the initial second sub-pixel signal based on the initial second sub-pixel signal, and obtain third stimulus value signals of the initial third sub-pixel signal based on the initial third sub-pixel signal;

determine a gain value based on a maximum value and a minimum value in a stimulus value signal set, and perform a gain processing separately on one of the first stimulus value signals, one of the second stimulus value signals, and one of the third stimulus value signals based on the gain value, wherein the stimulus value signal set comprises the one of the first stimulus value signals, the one of the second stimulus value signals, and the one of the third stimulus value signals;

obtain a fourth sub-pixel signal based on a minimum value in the stimulus value signal set after the gain processing;

obtain a converted first sub-pixel signal based on a difference between any one of the first stimulus value signals after the gain processing and the minimum value, obtain a converted second sub-pixel signal based on a difference between any one of the second stimulus value signals after the gain processing and the minimum value, and obtain a converted third sub-pixel signal based on a difference between any one of the third stimulus value signals after the gain processing and the minimum value; and use the converted first sub-pixel signal, the converted second sub-pixel signal, the converted third sub-pixel signal, and the fourth sub-pixel signal as converted pixel signals, wherein the converted pixel signals are used to correspondingly drive the red sub-pixel, the green sub-pixel, the blue sub-pixel, and a white sub-pixel in the pixel unit.

14. The computer program product according to claim 13, wherein when the maximum value is greater than N times the minimum value and N is a value greater than 1, the gain value is determined based on a ratio of the maximum value to a signal difference; otherwise, the gain value is set to a preset gain value, wherein the signal difference is a ratio of the maximum value to the minimum value.

15. The computer program product according to claim 13, wherein the processor assigns the minimum value to any one of fourth stimulus value signals of the fourth sub-pixel signal to obtain the fourth sub-pixel signal, based on a relationship between the fourth sub-pixel signal and the any one of the fourth stimulus value signals.

16. The computer program product according to claim 15, wherein the fourth stimulus value signals are a stimulus value signal WX, a stimulus value signal WY, and a stimulus value signal WZ, and wherein the any one of the fourth stimulus value signals is the stimulus value signal WY.

17. The computer program product according to claim 13, wherein the first stimulus value signals are a stimulus value signal RX, a stimulus value signal RY, and a stimulus value signal RZ, wherein the second stimulus value signals are a stimulus value signal GX, a stimulus value signal GY, and a stimulus value signal GZ, and wherein the third stimulus value signals are a stimulus value signal BX, a stimulus value signal BY, and a stimulus value signal BZ.

18. The computer program product according to claim 17, wherein the stimulus value signal set after the gain processing comprises the stimulus value signal RY after the gain processing, the stimulus value signal GY after the gain processing, and the stimulus value signal BY after the gain processing.

19. The computer program product according to claim 17, wherein the stimulus value signal set after the gain processing comprises the stimulus value signal RX after the gain processing, the stimulus value signal GY after the gain processing, and the stimulus value signal BZ after the gain processing.

20. The computer program product according to claim 17, wherein obtaining the first stimulus value signals of the initial first sub-pixel signal based on the initial first sub-pixel signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

obtaining the second stimulus value signals of the initial second sub-pixel signal based on the initial second sub-pixel signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and obtaining the third stimulus value signals of the initial third sub-pixel signal based on the initial third sub-pixel signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein RX is the stimulus value signal RX, RY is the stimulus value signal RY, RZ is the stimulus value signal RZ, and R is the initial first sub-pixel signal, wherein GX is the stimulus value signal GX, GY is the stimulus value signal GY, GZ is the stimulus value signal GZ, and G is the initial second sub-pixel signal, wherein BX is the stimulus value signal BX, BY is the stimulus value signal BY, BZ is the stimulus value signal BZ, and B is the initial third sub-pixel signal, wherein T is a maximum pixel signal value, wherein γRX, γRY, and γRZ are all stimulus value power functions of the initial first sub-pixel signal, wherein γGX, γGY, and γGZ are all stimulus value power functions of the initial second sub-pixel signal, and wherein γBX, γBY, and γBZ are all stimulus value power functions of the initial third sub-pixel signal.

* * * * *